US007673913B2

(12) United States Patent
Lindh

(10) Patent No.: US 7,673,913 B2
(45) Date of Patent: Mar. 9, 2010

(54) TOOL FOR PICKING UP A GOLF BALL

(76) Inventor: Hans Lindh, Norrbackagatan 12, S-113 41 Stockholm (SE)

( * ) Notice: Subject to any disclaimer, the term of this patent is extended or adjusted under 35 U.S.C. 154(b) by 0 days.

(21) Appl. No.: 10/574,425

(22) PCT Filed: Sep. 10, 2004

(86) PCT No.: PCT/SE2004/001304

§ 371 (c)(1),
(2), (4) Date: Apr. 4, 2006

(87) PCT Pub. No.: WO2005/032666

PCT Pub. Date: Apr. 14, 2005

(65) Prior Publication Data

US 2007/0120385 A1 May 31, 2007

(30) Foreign Application Priority Data

Oct. 6, 2003 (SE) ..... 0302638

(51) Int. Cl.
*A63B 47/02* (2006.01)

(52) U.S. Cl. ..... 294/19.2

(58) Field of Classification Search ..... 294/19.2; 473/286

See application file for complete search history.

(56) References Cited

U.S. PATENT DOCUMENTS

| | | | | |
|---|---|---|---|---|
| 2,523,942 | A * | 9/1950 | Ciambriello | 294/19.2 |
| 2,738,214 | A | 3/1956 | Zimmers | 294/19.2 |
| 3,046,044 | A * | 7/1962 | Christle | 294/19.2 |
| 3,265,430 | A * | 8/1966 | Jenkins | 294/19.2 |
| 3,442,544 | A * | 5/1969 | Faber | 294/19.2 |
| 3,887,225 | A * | 6/1975 | McKee | 294/19.2 |
| 4,046,413 | A | 9/1977 | Jeninga | 294/19.2 |
| 4,313,632 | A | 2/1982 | King et al. | 294/19.2 |
| 5,997,062 | A * | 12/1999 | Schwartz | 294/19.2 |
| 6,454,331 | B1 | 9/2002 | Ahlenius | 294/19.2 |
| 6,695,370 | B2 * | 2/2004 | Johnson | 294/19.2 |
| 2005/0179271 | A1 * | 8/2005 | Kerr | 294/19.2 |
| 2006/0138791 | A1 * | 6/2006 | Lebovici | 294/19.2 |

OTHER PUBLICATIONS

International Search Report PCT/SE2004/001304, dated Nov. 11, 2004.

* cited by examiner

*Primary Examiner*—Paul T Chin
(74) *Attorney, Agent, or Firm*—Ostrolenk Faber LLP

(57) ABSTRACT

A golf ball retrieval tool including an elongated handle which carries at one end a cage. The cage has a first section located near the elongated section and a second section located distally from the handle and connected to the first section. The first cage section has a first opening opened in a first tool orientation to freely receive a golf ball. The second section includes a downwardly open second opening which forms a ball seating. When the tool is in the first cage orientation, the handle extends obliquely downwards beneath the horizontal plane of the cage. The cage further includes a roof structure which in response to pressing the cage generally vertically against a ball generates on the ball a wedging action such as to drive the ball into the second section where the ball can be received in the ball seating.

5 Claims, 2 Drawing Sheets

TOOL FOR PICKING UP A GOLF BALL

CROSS REFERENCE TO RELATED APPLICATION

The present application is a 35 U.S.C. 00 371 national phase conversion of PCT/SE2004/001304, filed Sep. 10, 2004, which claims priority of Swedish Application No. 0302638-2, filed Oct. 6, 2003. The PCT International Application was published in the English language.

BACKGROUND OF THE INVENTION

The present invention relates to a golf ball retrieving tool of the kind defined in the preamble of Claim 1.

Tools for retrieving golf balls from, for example, a water collection or from ground that is not readily accessed are known, for instance, from U.S. Pat. No. 2,738,214, U.S. Pat. No. 2,482,338 and U.S. Pat. No. 6,454,331.

SUMMARY OF THE INVENTION

One object of the present invention is to provide an improved tool of the kind indicated, for facilitating retrieval of a ball by means of the tool and also to enable a ball to be inserted into the tool, and also to provide improvements with regard to retaining a ball captured in the tool, when lifting and drawing-in the tool after capturing a ball. These objects are achieved either completely or partially by means of the present invention.

The invention is defined in the accompanying independent claim. Further embodiments of the invention are defined in the dependent claims.

The inventive tool is of the kind designed to enable the retrieval of a golf ball that is located at a distance from the tool user, for instance a golf ball that has landed in the shallow water of a water obstacle or which is visible in not-readily penetrated brush or undergrowth. The tool comprises an elongate handle which carries a so-called cage at one end thereof. The cage includes at its rear end, facing towards the handle, a first section and at its opposite forward end relative to said handle a second section which connects with the first section generally immediately opposite its connection with said end of the handle, wherein the first section of the cage has in a first cage orientation an opening edge which is open downwardly and rearwardly along the handle so as to enable the cage to freely receive a golf ball, wherein the second section has a downwardly facing opening that forms a seating in which the ball can be supported, and wherein the handle extends obliquely downwards beneath the cage horizontal in the first cage orientation. A third opening which connects the first section with the second section defines a boundary between said two sections and forms a threshold over which the ball must run as moves freely through the third opening to the second section in said first cage orientation. The handle enables the cage to be lowered generally vertically down over the ball, which then enters the first section via the first opening. According to a novel and important feature of the invention, the first cage section includes a roof structure which is designed to exert a wedging effect on the ball in response to vertical downward movement into contact with the ball, such that the ball will be moved in a direction towards said second section, wherewith the ball runs into the cage over said threshold and is received in the seating in the second section.

The wedging effect can be achieved either by causing the roof as such to slope vertically upwards towards the second section, or by including in the roof structure, a wedge-shaped opening which widens in a direction towards the second section. Another important feature of the present invention is that the seat opening is designed for elastic deformation from a diameter which is smaller than the diameter of the ball to a size which is greater than the diameter of said ball when the cage is pressed down vertically against a ball, which is therewith received in the seating on the outside of the cage so as to enable the ball to be is pressed into the second section via the seating opening. In this regard, the seating opening and the opening between the first and the second sections may be joined via a waist which thus defines said threshold and that enables the seating opening to widen in a controlled fashion.

According to another important feature of the present invention, the ball seating in the second section is adapted so that the centre-of-gravity of the ball will be located beneath the geometric axis of the handle in said first cage orientation, so that the weight of the ball will generate a torque which tends to twist the tool about the axis of the handle into said first cage orientation, wherein the cage is also designed to hold the ball in the first section in a second cage orientation in which the cage has been rotated through 180 degrees about said axis from the first cage orientation, said ball being held in the first section in a position in which the centre-of-gravity of the ball lies beneath the axis of the handle. This effect is achieved by positioning that part of the second cave section which lies opposite the seating at a corresponding distance from the handle axis.

The invention will now be described by way of example with reference to the accompanying drawing.

DESCRIPTION OF A PREFERRED EMBODIMENT

Figure 1:
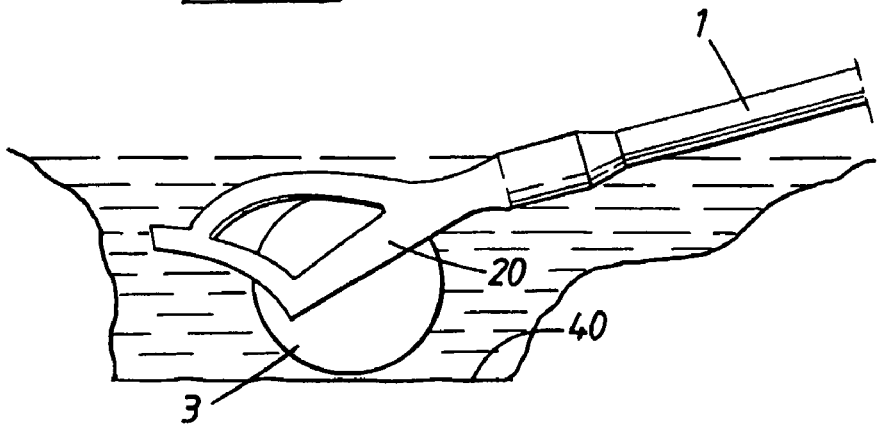
FIG. 1 is a schematic illustration of an inventive tool when used to recover a golf ball from a water collection.

The tool illustrated in FIG. 1 comprises an elongate handle 1 which carries at one end a so-called cage 20 for retrieving a golf ball 3 from an underlying surface 40. In a first cage orientation, shown in FIG. 1 and in FIG. 4, the geometric axis 10 of the handle 1 is inclined to the horizontal plane at an angle (alpha) of roughly 15 degrees, said cage 20 being located at the lower end of the handle 1 in the FIG. 1 and 4 cage orientation.

The cage 20 comprises a first section 21 that includes an inlet opening 31 which faces generally downwards and rearwards in respect of the handle 1, so as to allow the golf ball 3 to run freely through the opening 31 in the first section 21. The first section 21 connects with a following second section 22 via a transit opening 32. The lower part of the section 22 includes an opening 33 whose size is slightly smaller than the diameter of the golf ball 3, so as to form a golf ball seating 33. When the golf ball 3 has been received in the seating 33, the centre-of-gravity of the ball will be situated beneath the geometric axis 10 of the handle in the first cage orientation of the tool shown in FIG. 4.

The openings 33 and 31 lie in a plane that is inclined at an angle of about 30 degrees to the horizontal plane, and are mutually connected via a waist in the transit opening 32. The waist is defined by two mutually opposing shoulders 35 that form a threshold over which the ball 3 must pass in its passage into the section 22.

Figure 2:
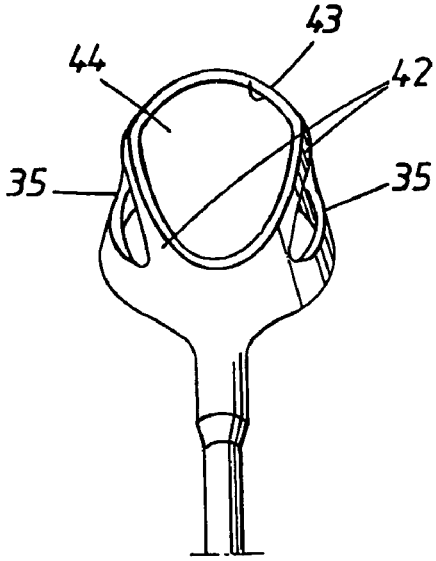
FIG. 2 shows the ball-retrieving cage of the tool from above.
Figure 3:
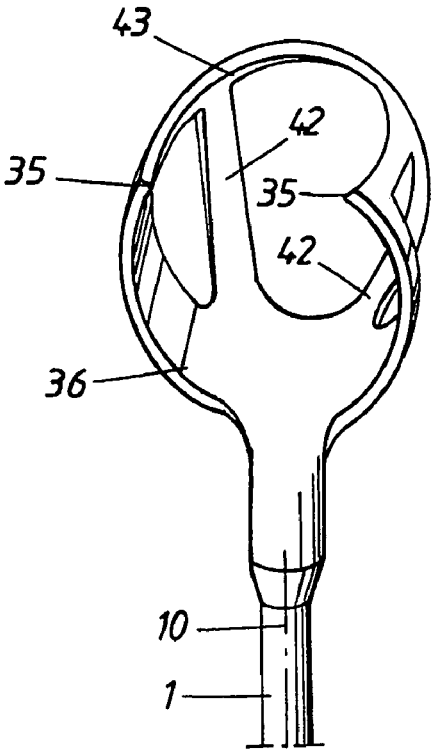
FIG. 3 is a perspective view of the cage shown in FIG. 2, from below.

The cage 20 has a roof structure comprised of two ribs 42 which are positioned symmetrically in relation to the geometric axis 10 and diverge in a direction towards the second section 22. As will be seen from FIGS. 4 and 2, when the cage 20 is pressed down against the ball 3generally vertically in the position shown in FIG. 4, the upper surface of the ball 3 will come into contact with the ribs 42 and therewith be subjected to a wedging action which tends to drive the ball 3 forwards in a direction towards the cage section 22, said wedging action also functioning to drive the ball 3 over the threshold formed by the shoulders 35. As an alternative to the divergent ribs 42, or as a complement to said ribs, the upper wall of the cage 20 may be caused to slope upwards from the section 21 towards the section 22 in the FIG. 4 orientation of the tool. When the cage roof is devoid of divergent ribs 42 that contribute towards displacement of the ball 3 towards the second cage section 22, the roof may slope at an angle of 15 degrees for instance.

The seat opening 33 in the cage section 22 is delimited by a seat ring 43.

Figure 4:
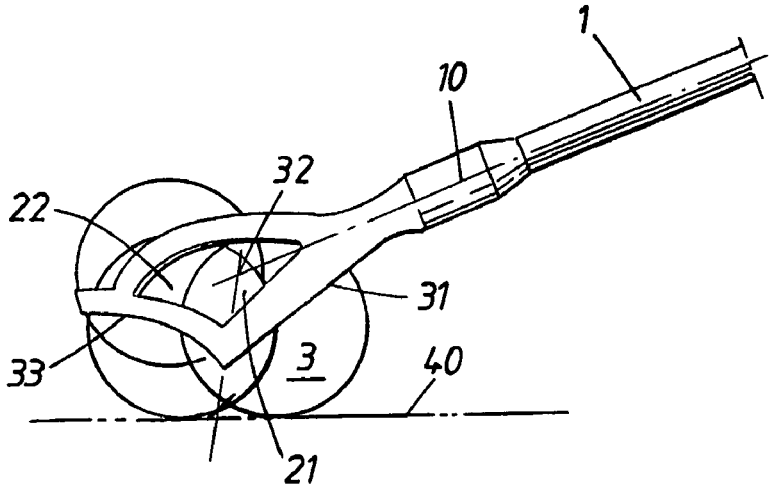
FIG. 4 illustrates the pattern of movement of a golf ball during its reception in the tool cage.

The roof of the cage section 22 is defined by the ribs 42 and an edge portion of the seating ring 43, which delimits an opening 44 that provides a stable seating for the ball 3 when the roof 1 is turned through 180 degrees from the orientation shown in FIG. 4, wherewith the centre of gravity of the ball 1 will again lie beneath the axis 10. This reduces the risk of the ball 3 falling from the cage 20 when withdrawing the tool after having retrieved a ball in the cage 20.

Figure 5:
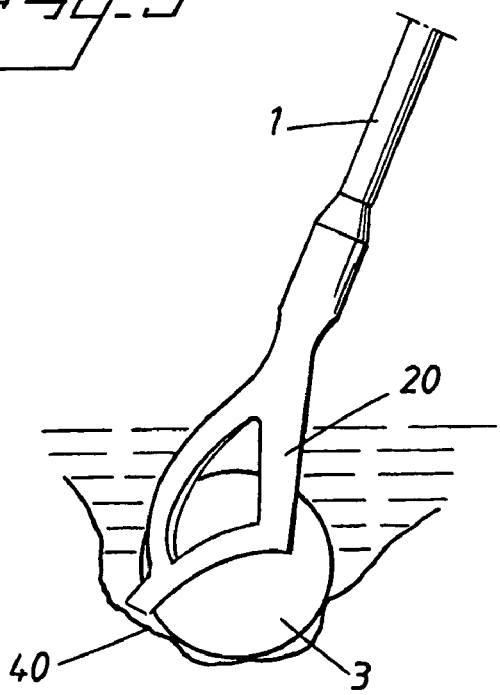
FIG. 5 illustrates an alternative method of use of the ball retrieving tool.

Because the seating ring 43 delimiting the opening 33 does not form a closed ring but merges with the cage end 36 via the waist defined by the shoulders 35, said cage end defining the cage opening 31, the opening 33 can be widened elastically by virtue of the seating ring 43 defined by the opening 33 being forced over the upper side of the ball 3 from above, due to the elastic resilience of said edge portion 43, and by virtue of having a free diameter which is only slightly smaller than the diameter of the golf ball 3, so as to enable the golf ball to be forced-in through the opening 33, as shown in FIG. 5.

The cage 20 will preferably have a lattice structure, as shown, so as to enable the user to see the ball 3 through the cage walls, although it will be obvious that the openings of the cage lattice work can be covered with a transparent or opaque wall material. The lattice openings need not be functional in achieving passage of the golf ball.

The invention claimed is:

1. A golf ball retrieval tool comprising:

an elongated handle; and a cage located at one end of the elongated handle, the cage having a rear end facing the elongated handle, a first section located at the rear end of the cage, a front end facing away from the elongated handle, a second section located at the front end and connected to the first section, and a roof extending from the rear end to the front end, wherein the first cage section has a first opening located generally opposite the roof of the cage and adjacent the elongated handle and dimensioned to freely receive a golf ball, wherein the first opening is open downwards and rearwards when viewed from the roof of the cage, wherein the second section includes a second opening located generally opposite the rear end of the cage and having a diameter smaller than a diameter of the golfball so as to form a ball seating retaining the golfball therein, the second opening being operable to be enlarged by pressing the golfball through the second opening, and wherein the roof of the cage has a third opening dimensioned to allow the golfball to protrude through the third opening above the roof of the cage, the roof of the cage having a wedge-shaped configuration operable, when viewed from the rear, to drive the golfball received through the first opening into the ball seating in response to pressing the cage generally vertically against the golfball.

2. A tool according to claim 1, wherein a threshold is formed between the first section and the second section of the cage, the threshold being operable to prevent the golfball from rolling from the ball seating into the first cage section until the tool is forced into a position in which the elongated handle is positioned horizontally.

3. A tool according to claim 2, wherein a plane defined by an edge of the second opening defines an angle with respect to a longitudinal axis of the elongated handle.

4. A tool according to claim 1, wherein a plane defined by an edge of the second opening defines an angle with respect to a longitudinal axis of the elongated handle.

5. A tool according to claim 1, wherein the ball seating is operable to position a center of gravity of the golfball beneath a longitudinal axis of the elongated handle and the cage roof is operable to retain the golfball in a position in which the center of gravity of the golfball lies beneath the longitudinal axis of the elongated handle when the cage is rotated 180 degrees about the longitudinal axis of the elongated handle so as to position the roof downwardly.

* * * * *